US006692316B2

(12) United States Patent
Hsieh et al.

(10) Patent No.: US 6,692,316 B2
(45) Date of Patent: Feb. 17, 2004

(54) HIGH CURRENT TERMINAL BLADE TYPE SEALED CONNECTION SYSTEM

(75) Inventors: Shao C. Hsieh, Warren, OH (US); Mark D. McCall, Hubbard, OH (US); Michael C. Wolczak, Greenville, SC (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/122,177

(22) Filed: Apr. 16, 2002

(65) Prior Publication Data

US 2003/0194919 A1 Oct. 16, 2003

(51) Int. Cl.[7] ..... H01R 13/189

(52) U.S. Cl. ..... 439/845; 439/224; 439/275; 439/857

(58) Field of Search ..... 439/845, 851, 439/855, 271, 274, 275, 587, 589, 857, 224

(56) References Cited

U.S. PATENT DOCUMENTS 4,632,475 A * 12/1986 Tomita ..... 439/224
5,824,962 A * 10/1998 Katsuma ..... 174/135
5,911,605 A * 6/1999 Wooldridge et al. ..... 439/790
5,941,721 A * 8/1999 Fukuda ..... 439/275
6,139,351 A 10/2000 Schaefer et al. ..... 439/372
6,276,960 B1 * 8/2001 Schaefer et al. ..... 439/522
6,287,156 B1 * 9/2001 Swan et al. ..... 439/845
6,416,340 B2 * 7/2002 Schaefer et al. ..... 439/224
6,478,635 B2 * 11/2002 Charles et al. ..... 439/851

* cited by examiner

*Primary Examiner*—Hien Vu
(74) *Attorney, Agent, or Firm*—David P. Wood

(57) ABSTRACT

A high current terminal blade connection system adapted for automotive environments, which provides environmental sealing includes a female connector and a male connector. The male connector includes a male power terminal having a contact blade and a means for connecting a power cable thereto. The female connector includes a female power terminal with a terminal blade seat for contactibly receiving the contact blade of the respective male power terminal. A contact insert is inserted within the female terminal and is the direct receiver of the male terminal contact blade. The contact insert includes dimples to provide stability and additional contact points to improve the electrical performance of the connection, and contact vanes to accept the mating male terminal blade for an in-line and right angle direction termination with the mating terminal blade. This design allows one female terminal and one contact insert for two different mating directions, thus eliminating the need for any additional parts.

7 Claims, 3 Drawing Sheets

RIGHT ANGLE

IN-LINE

HIGH CURRENT TERMINAL BLADE TYPE SEALED CONNECTION SYSTEM

BACKGROUND OF THE INVENTION

The present invention relates generally to electrical connectors, more specifically a high current terminal blade connection system that is suitable for an automotive environment and is capable of handling electrical current in excess of 100 amperes continuous current, either alternating current or direct current.

A problem frequently encountered in automotive electronics is a lack of power connection systems that are capable of handling in excess of 100 amps. Prior art connection systems that meet the required current carrying capacity are extremely expensive, bulky, and were not designed for an automotive application. Most of these connectors were intended for military applications, have too many parts, lack self-contained safety features, and are expensive and/or difficult to assemble.

With the advent of hybrid electric vehicles, there is now a need for an electrical power connection system that is configured for an automotive environment and able to safely handle large power loads.

Accordingly, it is felt that there is a need in the art for a high powered connection system for automotive environments that handles electrical currents in excess of 100 amps, has a reduced number of parts, may be easily assembled, and stabilized contact for improved performance.

SUMMARY OF THE INVENTION

The present invention is a high current terminal blade connection system that handles electrical currents in excess of 100 amps, has a reduced number of parts required for various mounting configurations, may be easily assembled without resort of fasteners, and is environmentally sealed to prevent shorting between circuits.

The high current terminal blade connection system, according to the present invention, includes a female connector and a male connector. A male power terminal includes a contact blade and a means for connecting a power cable, thereto. The male connector has a male power terminal cavity for receiving therein the respective male power terminal, wherein the contact blade of the received male power terminal projects from a forward end of the male connector. The female connector has a female power terminal cavity for receiving therein a respective female power terminal, wherein the female contact of the received power terminal is located adjacent to the female connector at a forward end. The forward ends of both the male and female connectors are configured to mutually mate such that the contact blade of the male power terminal passes through a respective blade slot and seats into a respective blade seat of a respective female power terminal.

A contact insert is located within the female power terminal cavity. The contact insert includes dimples to provide additional support to the terminal blade, thus enhancing the performance of the connection, and contact vanes are designed into the insert to accept the mating blade in an in-line and right angle direction. The benefit of this design is that there is one female terminal and one contact insert needed for two different mating directions, thus eliminating the need for any additional parts.

Both the male and female connectors can include the cable seal stop tabs that allow the cable seal to push against the terminal and not slip over the insulation crimp. When the terminal position assurance (TPA) is employed, it pushes against the cable seal which in turn pushes against the stop tabs and forces the terminal to seat properly in it's respective cavity. The benefit of this is that the die progression is shorter because the traditional method of crimping the cable seal in the insulation wings is no longer needed; therefore, there is less material needed in the insulation wing.

The electrical performance of the connection provided by this connection system is improved with the addition of the dimples to the contact insert. These dimples provide stability and additional contact points when the male terminal blade and contact insert are mated together.

BRIEF DESCRIPTION OF THE DRAWINGS

The various advantages of the present invention will become apparent to one skilled in the art by reading the following specification and subjoining claims and by referencing the following drawings in which:

DETAILED DESCRIPTION OF THE INVENTION

Figure 1:
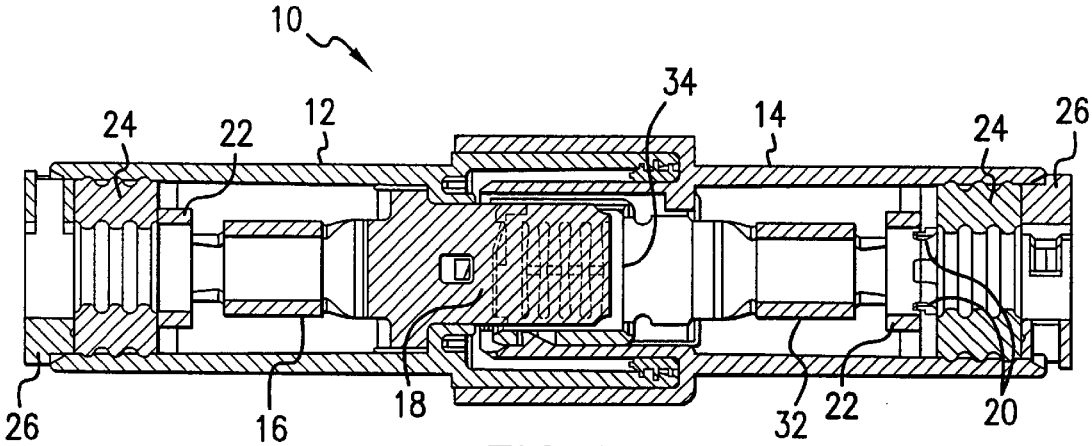
FIG. 1 is a simplified perspective drawing of an embodiment of the presently claimed invention.
Figure 2:
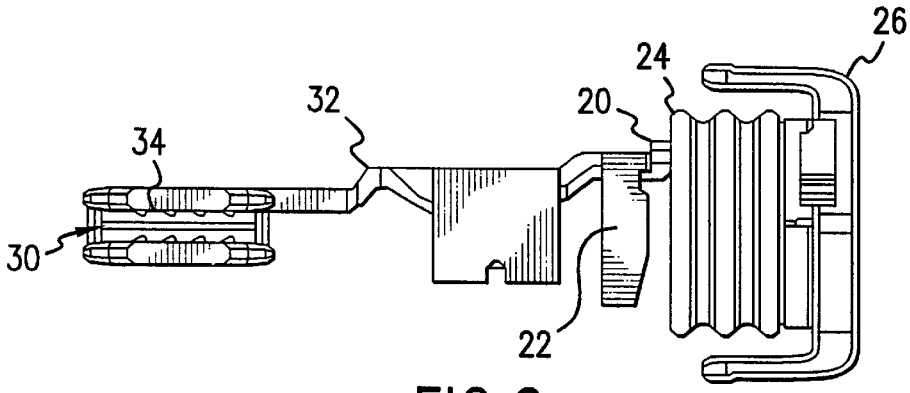
FIG. 2 is a perspective drawing of the relationship of the female terminal, cable seal, and the terminal position assurance (TPA)

In one embodiment of the presently disclosed invention, the high current terminal blade connection system 10 includes a male connector 12 and a female connector 14. In FIGS. 1 and 2, a high current terminal blade connection system 10 is shown having a male connector 12 and a female connector 14 mated together in an interlocked fashion. A male connector 12 includes a male power terminal 16 with a male terminal blade 18 at the forward end of the male connector 12. Seal stop tabs 20 are located on back ends of the insulation crimp 22 of the male and female power terminals 16, 32. The tabs 20 allow the cable seal 24 (See FIG. 2) to push against the terminals 16, 32 and not slip over the insulation crimp 22. When the terminal position assurance [TPA] 26 is employed, as shown, e.g., in FIG. 2, it pushes against the cable seal 24 which in turn pushes against the stop tabs 20 and forces the female power terminal 32 to seat in the female power terminal cavity.

The female connector 14 in this embodiment has a U-shape female contact 31 to accommodate the male terminal blade 18 when received in the female power terminal cavity 30. The female power terminal 32 is located adjacent a forward end of the female connector 14 so that the forward ends of both the male and female connectors 12, 14 can mutually mate and the male terminal blade of the male power terminal 16 pass through the female power terminal cavity 30 and seats into the female power terminal 32 within a contact insert 34.

Figure 3:
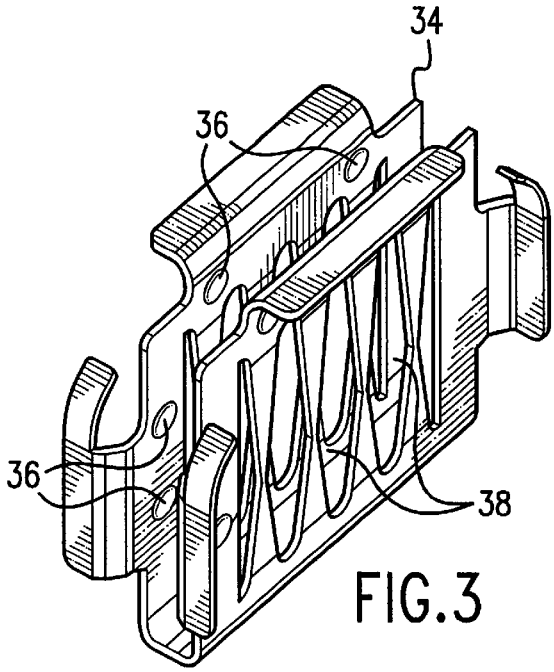
FIG. 3 is a perspective drawing of a contact insert.

FIG. 3 depicts a contact insert 34 with dimples 36. The dimples 36 are located on the contact insert 34 to provide additional support to the mating male terminal blade 18, thus enhancing the performance of the connection when the male and female connectors 12, 14 are interlocked. The benefit of this design is that the connection is firmly supported, thus reducing the tendency of the contact from rocking, which has been a factor in promoting contact corrosion. The dimples 36 also provide stability and additional contact points, which improve the electrical performance of the connection. The dimples 36 may be associated in pairs, one of each pair on either surface of the U-shaped female contact insert 34.

Figure 4:
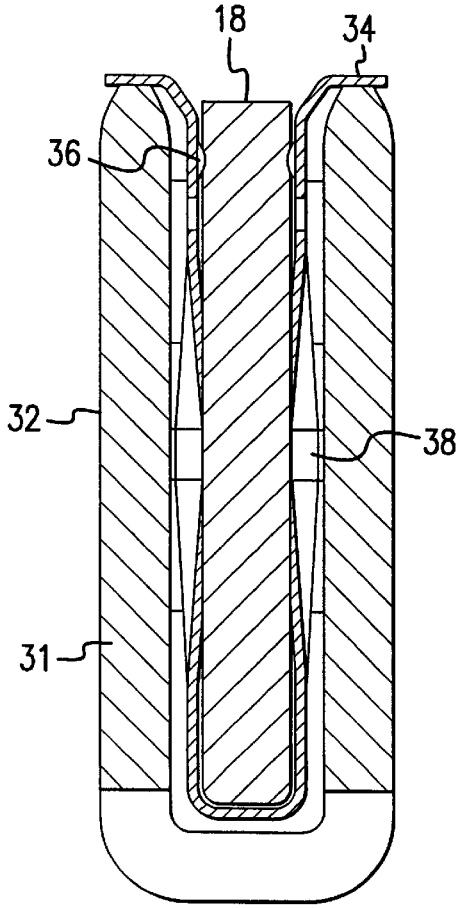
FIG. 4 is a cross sectional view of a male and female terminal mated in a contact insert.
Figure 5A:
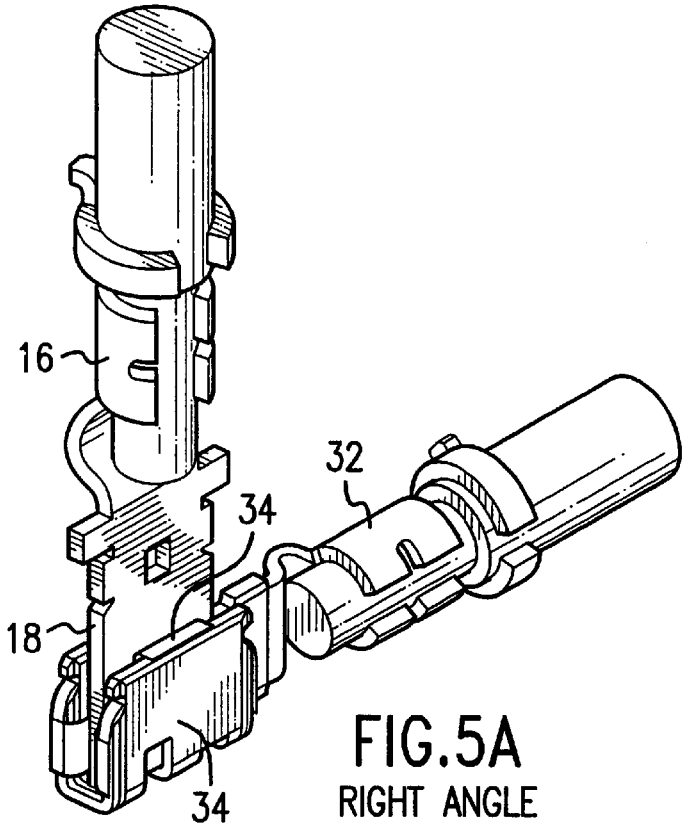
FIG. 5*a* is a perspective view of a right angle configuration of male and female terminals.
Figure 5B:
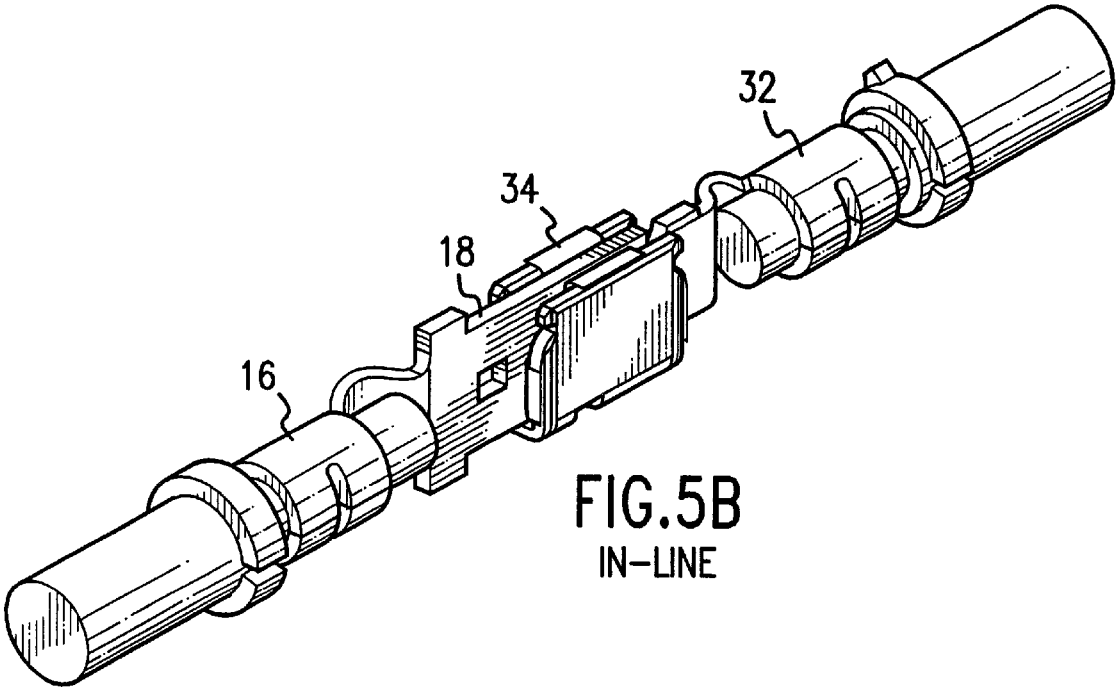
FIG. 5*b* is a perspective view of an in-line connection of the male and female terminals.

In FIG. 4, the male power terminal blade 18 is inserted in the female power terminal 32 within the contact insert 34 of the female terminal cavity 30. The crisscrossed sectional view shows the dimples 36 in associated pairs, and contact vanes 38, which are also located on the interior of the contact insert 34. The contact vanes 38 configured within the contact insert 34, accept the mating male terminal blade 18. The contact vanes 38 permit both right angle (FIG. 5*a*) and in-line (FIG. 5*b*) insertions of the male terminal blade 18 within the contact insert 34. The benefit of this design is that there is one female terminal and one contact insert needed for two different mating directions, thus eliminating the need for any additional parts. The contact vanes 38 may be associated in pairs, one of each pair on either interior surface of the U-shaped contact insert 34.

Delphi Automotive Systems has designed the commercial version of this high current terminal blade connection system as a compliment to their existing high current terminal blade type seal connection terminal line.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specifications, and following claims.

What is claimed is:

1. A high current terminal blade connection system, comprising:

a male power terminal comprising a contact blade and means for connecting a power cable to said male power terminal;

a male connector having a forward end and an opposite back end, said male connector further having a male power terminal cavity for receiving therein said male power terminal, wherein the contact blade of said male power terminal projects from said forward end of the male connector;

said male connector further having a first insulation crimp disposed between said male power terminal and said back end of said male connector;

a female power terminal comprising a female contact and a means for connecting a power cable to said female power terminal, the female contact having a cavity for contactibly receiving a contact insert;

said contact insert having a cavity for contactibly receiving the contact blade of said male power terminal;

a female connector having a forward end and an opposite back end, said female connector further having a female power terminal cavity for receiving therein said female power terminal and said contact insert, wherein said contact insert, positioned in said female power terminal, is located adjacent said forward end of said female connector, and wherein said forward ends of said male and female connectors are configured to mutually mate such that the contact blade of said male power terminal passes through the female power terminal cavity and seats into a position within said contact insert within the female power terminal;

said female connector further having a second insulation crimp disposed between said female power terminal and said back end of said female connector;

said male and female connectors including cable seal stop tabs located on respective back ends of said first and second insulation crimps so as to allow first and second cable seals to push against said male and female power terminals, respectively, and not slip over said means for connecting a power cable to said male power terminal and said means for connecting a power cable to said female power terminal, respectively; wherein the cable seal stop tabs in the female connector are further disposed such that said second cable seal pushes against said cable seal stop tabs which in turn forces said female power terminal to be seated in said female power terminal cavity;

wherein said cable seal stop tabs disposed in the female connector, said female terminal and said contact insert are aligned in a coplanar relationship relative to one another;

said contact insert including at least one dimple to provide additional support to an insertion of said contact blade into said contact insert; and said contact insert including at least one contact vane, the at least one contact vane being configured to accept said insertion of said contact blade in either an in-line or right angle direction;

wherein said at least one dimple is located on an interior surface of said contact insert; and wherein said at least one contact vane is located to contact both of said male and female power terminals of said contact insert.

2. A connecting system according to claim 1, wherein said means for connecting a power cable to said male power terminal and said means for connecting a power cable to said female power terminal each employ terminal position assurance for proper alignment and positioning of said first and second cable seals, respectively, against said cable seal stop tabs.

3. The connection system according to claim 2, wherein said terminal position assurance provides said first and second insulation crimps.

4. The connection system according to claim 1, wherein said female terminal cavity comprises a U-shape.

5. The connection system according to claim 4, wherein said contact insert comprises a U-shape.

6. The connection system according to claim 5, comprising a plurality of said at least one dimple, wherein said dimples are associated in pairs, one of each pair on either surface of said U-shape contact insert.

7. The connection system according to claim 6, comprising a plurality of said at least one contact vane, wherein said contact vanes are associated in pairs, one of each pair on either surface of said U-shape contact insert.

* * * * *